United States Patent [19]

Ito et al.

[11] Patent Number: 4,827,993

[45] Date of Patent: May 9, 1989

[54] AUTOMATIC CARRYING AND METERING SYSTEM FOR LIQUID RESERVOIR

[75] Inventors: Yoshito Ito; Hideyo Miyake; Hiroshi Tamagawa, all of Yokohama, Japan

[73] Assignee: Nippon Paint Co., Ltd., Osaka, Japan

[21] Appl. No.: 100,564

[22] Filed: Sep. 24, 1987

[30] Foreign Application Priority Data

Oct. 28, 1986 [JP] Japan ..... 61-254782

[51] Int. Cl.[4] ..... B65B 1/32; B65B 1/30

[52] U.S. Cl. ..... 141/83; 141/104; 366/605

[58] Field of Search ..... 141/83, 104, 139, 198, 141/153, 155, 157, 178, 183, 187, 188; 366/605, 132, 141, 152, 160

[56] References Cited

U.S. PATENT DOCUMENTS 4,225,248 9/1980 Para ..... 366/605 X
4,403,866 9/1983 Falcoff ..... 366/160 X
4,518,208 5/1985 Marder .
4,585,148 4/1986 Ito ..... 222/77
4,705,083 11/1987 Rosetti ..... 141/83 X

FOREIGN PATENT DOCUMENTS 59-223607 12/1984 Japan .

*Primary Examiner*—Donald Watkins
*Attorney, Agent, or Firm*—Wenderoth, Lind & Ponack

[57] ABSTRACT

An automatic system for carrying a reservoir and metering liquid from the reservoir comprising a vertical shelf for storing a plurality of reservoirs therein, a transferring mechanism disposed adjacent the supply shelf for transferring a reservoir toward horizontal and vertical directions, a tilting device for receiving the reservoir and tilting it from an upright to a horizontal position, a valve mechanism for controlling a liquid flow through a valve attached to the reservoir, and a balance for supporting a collecting container to receive droppings from the valve. The transferring mechanism including a platform to support the reservoir thereon, an attracting means to draw out the reservoir, and a cylinder to move the reservoir back and forth.

4 Claims, 4 Drawing Sheets

AUTOMATIC CARRYING AND METERING SYSTEM FOR LIQUID RESERVOIR

BACKGROUND OF THE INVENTION

This invention relates to an automatic carrying and metering system for a liquid reservoir to carry the reservoir containing liquid materials such as paint therein from a supply shelf to a metering station and to put the reservoir back in its original position in the shelf automatically. This system can be utilized to establish an automatic paint mixing and paint metering process in such a field as automotive paintings where a plurality of colors and types of paints are employed.

Paint metering designs in the past often utilized fixed displacement pumps, in which designs metering operation has been achieved through an extruding action of the fixed displacement pump. Such a metering system of the displacement type, however, does not readily lend itself to use for a small amount of paint such as 0.01–0.4 g by weight, resulting in an inconvenience of rather limited accuracy. Another problem is the fact that in order to deal with a plurality of colors and types of paints prior design requires a plurality of fixed displacement pumps corresponding to the number of colors or types of the paint, so that the metering device becomes complicated and color modification can not be easily attained.

One solution for this problem was proposed in our U.S. Pat. No. 4,585,148 issued on Apr. 29, 1986. In this apparatus, fixed displacement pumps being removed, a sliding valve mechanism is attached to each reservoir and its valve drive member is driven by a pulse motor automatically. However, in its arrangement, a plurality of reservoir bases are mounted around the circumferences of a rotary table, resulting in a problem that the diameter of the table becomes larger occupying ever greater space as the number of reservoir increases.

SUMMARY OF THE INVENTION

It is an object of the present invention to provide a high-performance carrying and metering system which makes it possible to follow up a series of stages including the steps of selecting, taking out, transferring, metering and putting back a liquid reservoir without increasing the location size even if the number of colors or types of primary color become considerably greater.

Another object of the present invention is to provide a convenient automatic metering system which makes it possible to achieve a precise color matching operation through a computerized color matching process.

Still another object of the present invention is to provide an automatic metering system which can be utilized for mixing operation of miscellaneous liquids or chemicals other than paint.

The foregoing and other objects of the present invention are accomplished by an automatic carrying and metering system for liquid reservoir having a valve on its open to for closing the top comprising; a vertically arranged supply shelf for storing a plurality of liquid reservoirs therein, a transferring mechanism disposed adjacent said supply shelf for transferring a liquid reservoir toward horizontal and vertical directions, a tilting device for receiving the liquid reservoir and tilting it from an upright to a horizontal position, a valve mechanism for controlling a liquid flow through a valve attached to the reservoir, and a balance for supporting a collecting container to receive droppings from said valve, said transferring mechanism including a platform to support said liquid reservoir thereon, an attracting means to raw out the reservoir, and a cylinder to move the reservoir back and forth.

In the system according to the invention, a plurality of liquid reservoirs are accommodated within a vertical shelf, from which a selected reservoir is drawn out by an attracting means, such as a suction cup or a magnetic clamp, thereby being placed on a platform of a transferring mechanism. Then, the reservoir is transferred toward horizontal and vertical directions, being put into a tilting device. As the reservoir is tilted from an upright to a horizontal position, liquid contents flow out through a valve attached to the open top of the reservoir. The liquid flow out of the reservoir is controlled by a valve mechanism, while droppings of the liquid are metered by a balance supporting a collecting container thereon.

When a predetermined weight is collected into the container, the valve closes and the reservoir turns back to the upright position. Then, the reservoir is retracted from the tilting device, being placed on the platform. In the next place, the reservoir is transferred toward horizontal and vertical directions, being put back into the original position within the supply shelf.

Since a plurality of liquid reservoirs are set in place within a vertical shelf, accommodation spaces extend in three dimensional directions, whereby the location space of the system is kept nearly constant even if a great many reservoirs are prepared and stored. Each working element in the system can be controlled automatically, so that a computerized color matching process can be easily applied to the system.

Since each reservoir can be individually put into a standard or optional box of the supply shelf, many kinds of reservoirs having different contents, shape or size can be easily stored within the shelf.

Other objects, features and advantages of the invention will become apparent from a reading of the specification, when taken in conjunction with the drawings, in which, like reference numerals refer to like elements in the several views.

DESCRIPTION OF THE PREFERRED EMBODIMENT

Althogh the automatic carrying and metering system of the invention can be applied to many kinds of liquid, in this embodiment, the system is utilized in a color matching process for liquid colorant contained in a primary color reservoir.

Figure 1:
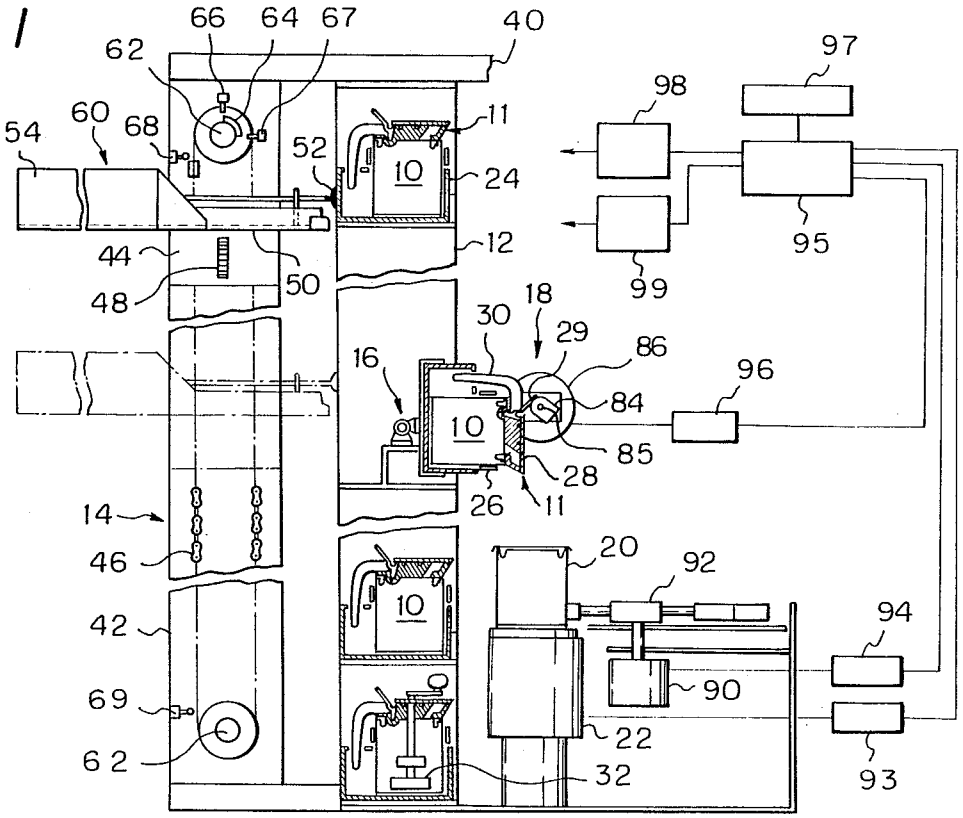
FIG. 1 is a side elevational view, partly in section, of an embodiment of the system according to the invention, accompanying a computer for accomplishing a computerized color matching process.

Referring to FIG. 1, there is shown a preferred embodiment of the invention, an automatic carrying and metering system for liquid reservoirs. The system includes a vertically arranged supply shelf 12 for storing a plurality of primary color reservoirs 10, a transferring mechanism 14 disposed adjacent the shelf 12 for transferring the reservoir 10 toward horizontal and vertical directions, a tilting device 16 for receiving the reservoir 10 and tilting it from an upright to a horizontal position, a valve mechanism 18 for controlling a liquid flow of a liquid colorant through a valve 11 attached to the open top of the reservoir 10, and an electronic balance 22 for supporting a collecting container 20 to receive droppings of the liquid colorant from the valve 11.

Figure 6:
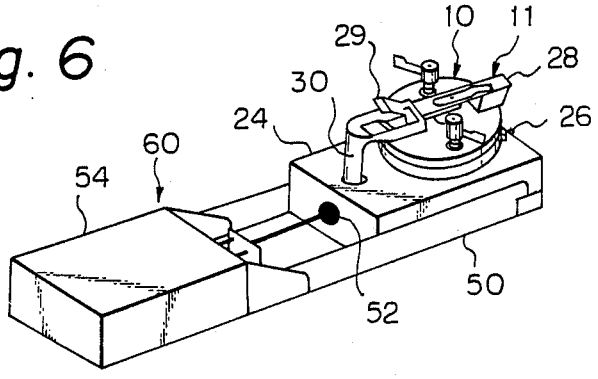
FIG. 6 is a perspective view illustrating a pull-out device of a transferring mechanism with a platform supporting a reservoir enclosed in a rectangular case.

As shown in FIG. 6, the primary color reservoir 10 is enclosed in a rectangular case 24, being detachably mounted by a fastener clamp 26. Further, the reservoir 10 is provided with a slide member 28 slidable in horizontal directions for opening and closing the valve 11, a lever 29 for actuating the slide member 28, and a handle 30 integral with a cover. In FIG. 1, the reservoir 10 shown in the bottom box of the shelf 12 is provided with an optional agitating blade 32.

Figure 2:
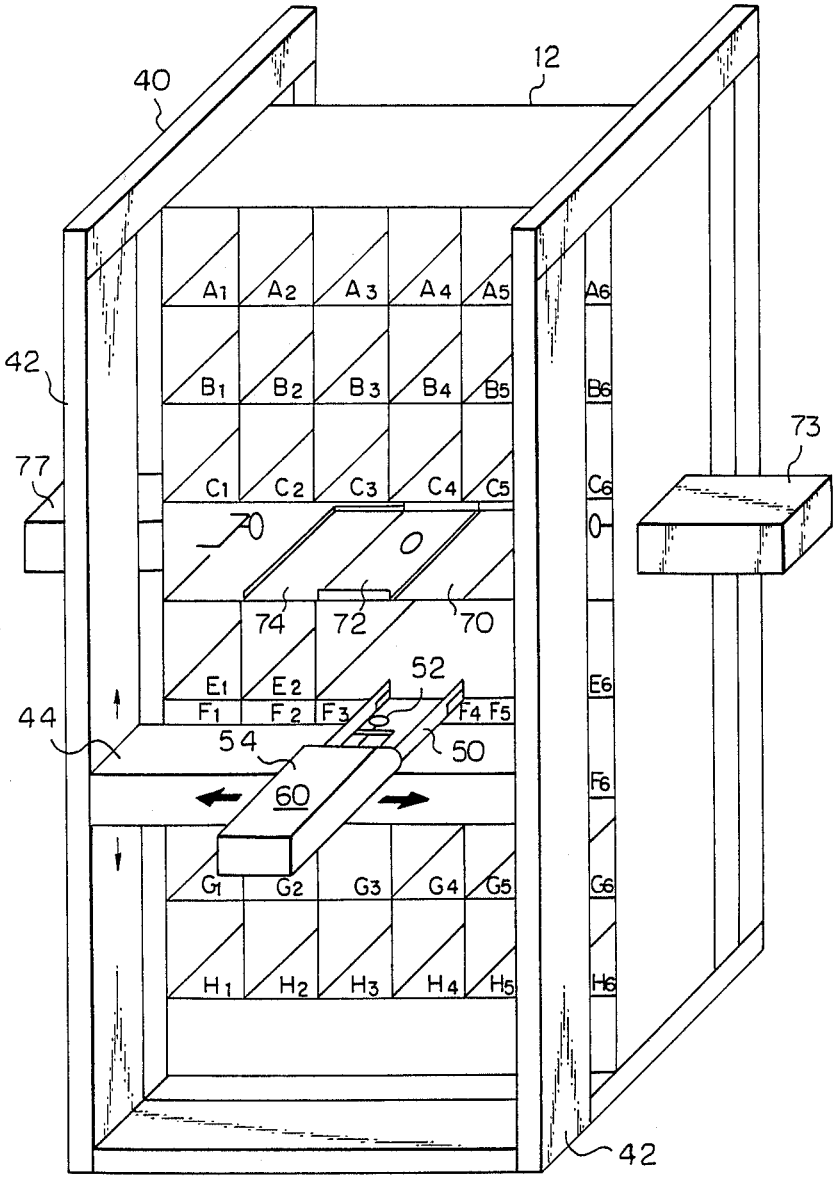
FIG. 2 is a front perspective view of FIG. 1.
Figure 3:
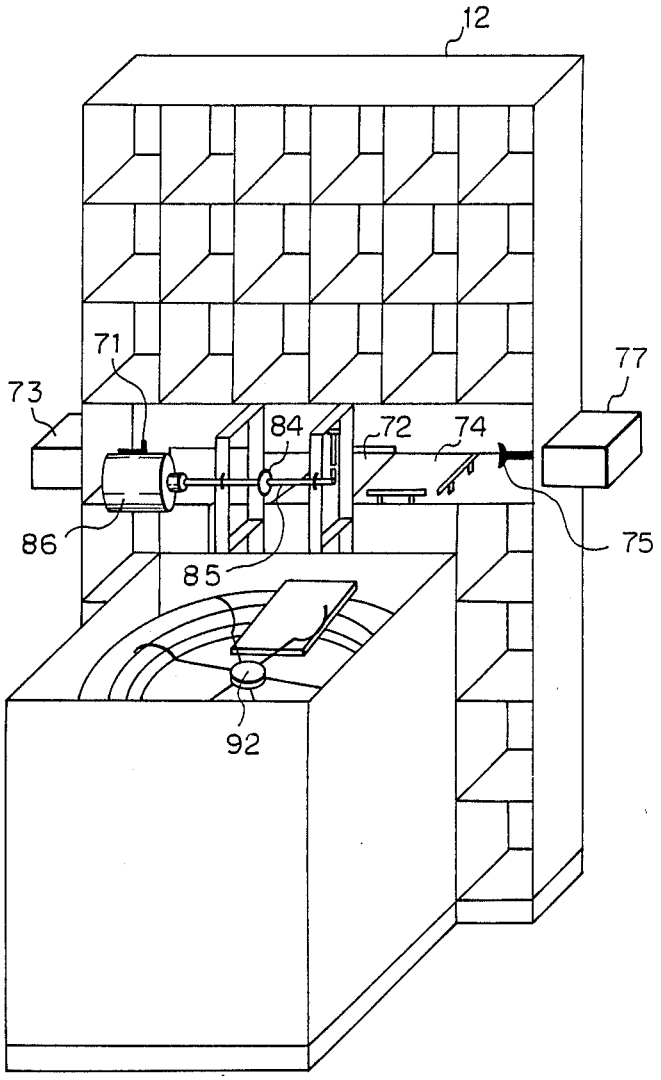
FIG. 3 is a backside perspective view of FIG. 1.

In FIGS. 2 and 3, the supply shelf 12 is made in a structural from comprising an outer plate divided into a plurality of open boxes piled up with partitions extending horizontal and vertical directions therebetween. FIG. 2 illustrates the open boxes comprising, A row of six, B row of six, C row of six, D row of nothing, E row of three, F row of six, G row of six, and H row of six, whereby a total of 39 boxes are made in 8 rows. It should be noted that the total number can be easily changed. A special space consisting of imaginary boxes, D row of six and E row of three (other than the aforementioned three), is prepared for the object of receiving and tilting a primary color reservoir.

Putting operation of the rectanglar case 24 with a reservoir 10 into or out of a desired box in the shelf 12 is easily done by gripping the handle 30 manually and moving it at the front side of the shelf 12 (shown in FIG. 2).

The primary color reservoir transferring mechanism 14, being disposed adjacent the shelf 12 and connected by a frame 40, comprises vertical posts 42 in right and left sides, and a horizontal beam 44 extending therebetween. The horizontal beam 44 moves up and down, being driven by a chain drive elevator 46 (shown in FIG. 1), which is located inside the vertical posts 42. The transferring mechanism 14 further comprises a pull-out device 60 which includes a platform 50 supporting the rectangular case 24, a suction cup 52 for drawing out the case 24, and an air cylinder 54 translating the case 24 back and forth. The pull-out device 60 moves right and left, being driven by a chain drive conveyor 48 (shown in FIG. 1).

Around the vicinity of a sprocket shaft 62 of the elevator 46, are disposed a sensing unit 64 and proximity sensors 66 and 67 for stopping the pull-out device 60 at a position registered with the bottom surface of each open box of the shelf 12. Further, at the top and bottom of the vertical post 42, are disposed limit switches 68 and 69 for setting up upper limit and lower limit positions defining the moving area of the pull-out device 60.

Similarly, the chain drive conveyor 48 is provided with a corresponding sensing unit, proximity sensors and limit switches.

Figure 4:
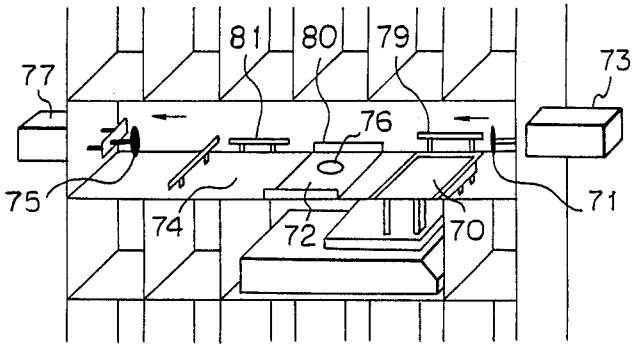
FIG. 4 is a front perspective view illustrating a tilting device in a supply shelf.

In FIG. 4, the tilting device 16 for receiving and tilting the rectangular case 24 with the reservoir 10 comprises a measuring section 70 for measuring a weight of the accepted case 24, a tilting section 72 for tilting the case 24 from an upright to a horizontal position, and a releasing section 74 for releasing the case 24 after completion of the metering operation. The case 24 is pushed by a rubber pad 71 actuated by an air cylinder 73, being transferred from the measuring section 70 to the tilting section 72, and is pulled by a suction cup 75 actuated by an air cylinder 77, being transferred from the tilting section 72 to the releasing section 74. An object of the measuring section 70 is to determine whether a sufficient quantity of primary color is contained in the reservoir 10 or not. If the quantity (measured by weight) is below the predetermined value, the case 24 is transferred bakc to the original box without being carried to the tilting section 72.

At the bottom surface of the tilting section 72, a circular hole is disposed and a suction cup 76 is mounted being adapted to move slightly up and down within the hole. When the case 24 is supplied from the measuring section 70 to the tilting section 72, the suction cup 76 is held in its lower position, so that there is no confliction between the case 24 and the suction cup 76. After the case 24 has arrived at the tilting section 72, the suction cup 76 moves upward and attracts the bottom surface of the case 24, whereby the case 24 can be tilted without sliping off the section 72 to a horizontal position shown in FIG. 1. It should be noted that the suction cup 76 is not shown in FIG. 1 for the purpose of clarifying the drawing.

At the lateral edges of the sections 70, 72 and 74, disposed corner guides 79, 80 and 81 acting as stopers for the case 24. Actuating means for tilting the section 72 can comprise an air cylinder 82 (shown in FIG. 5) or a motor.

Figure 5:
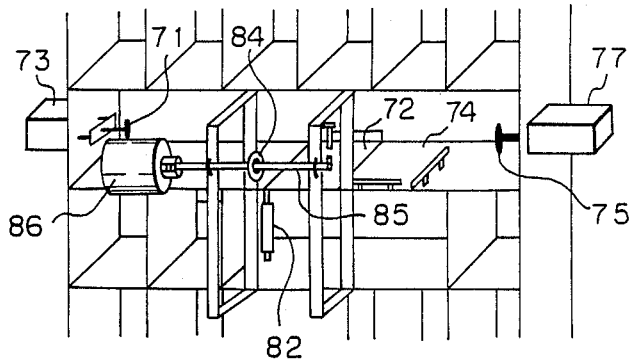
FIG. 5 is a backside perspective view illustrating a valve mechanism and a tilting device.

In FIGS. 1 and 5, the valve mechanism 18, controlling the liquid flow through the valve 11 attached to the reservoir 10 in a tilted position, comprises a cam 84 contacting with a lever 29 which acts as a drive member for actuating the slide member 28, and a pulse motor 86 for driving a cam shaft 85.

The collecting container 20, receiving droppings from the tilted reservoir 10, is supported on an electronic balance 22, so that the dropping weight of liquid colorant is immediately checked. After successive collecting steps handling a preselected number of primary colors by turns, an objectively mixed liquid colorant is obtained. Then, a turn table 92 driven by a motor 90 rotates and transfers the completed container 20 to a next process, whereby an empty collecting container 20 is supplied to the collecting position.

In FIG. 1, the aforementioned transferring mechanism, tilting device, drive means for the valve mechanism and several types of sensors are connected to a computer 95 by means of a driving circuit 94 for the motor 90, a driving circuit 96 for the pulse motor 86, a control circuit 98 for the transferring mechanism, and a control circuit 99 for the tilting device. Further, the electronic balance 22 is also connected to the computer 95 by means of a measuring circuit 93. Thus, a computer controlled color matching process is accomplished with the aid of a software program.

By virtue of the above described construction, a computer controlled operation of the system progresses as follows.

(1) An objective box position of the primary color to be metered is put into the computer by numerals of row and line. For example, if the objective box is B3 in FIG. 2, numerals 2 and 3 become input data. Next, a quantity to be metered is input. For example, when 100.0 g is to be metered, 100.0 become an input valve. When a plurality of primary colors should be metered, many data are put into the computer in succession.

(2) After completion of the input working, an automatic carrying operation is started. At first, the pull-out device 60 is moved to a reference position of the supply shelf 12, so that an initial value setting is performed.

(3) The elevator 46 and the conveyor 48 are put in motion by receiving an electrical signal from the computer, whereby causing the pull-out device 60 to move from the reference position to the objective position. As the result, the pull-out device 60 stops in front of the box B3.

(4) The air cylinder 54 and the suction cup 52 are energized, and the case 24 stored in the box B3 is attracted to be taken out, thereby getting on the platform 50 of the pull-out device 60 as shown in FIG. 6.

(5) By means of elevator 46 and conveyor 48, the pull-out device 60 is transferred from the B3 position to the measuring section 70 and stops in front of the section 70. Then, the air cylinder 54 pushes out the case 24 and the suction cup 52 is deenergized, whereby the case 24 gets on the measuring section 70.

(6) the weight of the case 24 is measured by a balance located inside the section 70, and the resulting weight of the liquid colorant is determined whether it is sufficient to the objective collecting weight or not. If it is described the weight of the liquid is be short of the collecting weight, the pull-out device 60 starts in motion attracting the case 24 into the platform 50, whereby the case 24 is put back into the original position B3.

(7) When it is decided the weight of the liquid is be sufficient, the air cylinder 73 is energized and the rubber pad 71 pushes against the case 24 moving it to the tilting section 72.

(8) The suction cup 76 moves slightly upward attracting the bottom surface of the case 24, and then the air cylinder 82 is energized to tilt the case 24 from the upright to a horizontal position toward the direction of the metering cam 84.

(9) The pulse motor 86 is energized to cause the cam 84 to contact with the lever 29, which is operated to move the slide member 28 up and down repeatedly, whereby droppings of liquid colorant through the valve 11 are collected into the container 20. The collected weight is metered by the electronic balance 22. When the predetermined weight is metered, the pulse motor 86 ceases its motion.

(10) After the metering operation, the air cylinder 82 is energized to put the case 24 back into the original upright position. The suction cup 76 is deenergized and moves slightly downward. Then, the suction cup 75 and the air cylinder 77 are energized to transfer the case 24 to the releasing section 74.

(11) The pull-out device 60 moves horizontally from the existing position in front of the measuring section 70 to a new position in front of the releasing section 74. The air cylinder 54 and the suction cup 52 are energized to attract and to draw out the case 24, whereby it gets on the platform 50 as shown in FIG. 6.

(12) The elevator 46 and the conveyor 48 start in motion transferring the pull-out device 60 to the position in front of the box B3, and then cease their motions.

(13) The air cylinder 54 is energized to push out the case 24 and the suction cup 52 is deenergized, whereby the case 24 is inserted into the box B3 coming back to the original position.

(14) When a plurality of primary colors are metered, the aforementioned steps No. 3 to No. 13 are cyclically repeated.

For example, when four primary colors of red, blue, black and white are metered in the computerized color matching process, and the colors are stored in individual boxes B4, C6, A2 and A1, respectively, the positions and colors are coded and put into the computer from an input station as follows:

| color position | | | | metering value |
|---|---|---|---|---|
| VT | HR | color No. | color | (g) |
| 2 | 4 | 15 | red | 9.5 |
| 3 | 6 | 11 | blue | 11.7 |
| 1 | 2 | 2 | black | 7.4 |
| 1 | 1 | 1 | white | 71.4 |

The control system can be performed by a sequence control method with the aid of many sensors and limits switches which detect a progress of sequence. Thus, a series of stages including the steps of selecting, taking out, transferring, metering and putting back primary color reservoirs are well performed automatically.

In the aforementioned embodiment of the invention, the liquid reservoir is enclosed in a rectangular case, being handled by a suction cup connected to a vacuum source. However, it is also possible to handle a liquid reservoir directly by means of an electromagnet without using a rectangular case.

Thus, as is apparent from the above description, the automatic carrying and metering system of the present invention can provide technical advantages as follows:

(a) Even if the types or numbers of primary color increase, there is no need for the system to have additional location spaces. Therefore, a great number of primary colors can be prepared for color matching operation almost unrestrictedly.

(b) Since a primary color reservoir stored in a box can be easily exchanged into another kind of reservoir, there is no limitation of types of primary color, so that the system can be easily applied to another kind of working.

(c) Since a supply shelf consists of a unit construction, it is easily made and modified with considerably low cost.

(d) Since the system extends to three dimensional directions, the location space is relatively small as compared with prior designs.

(e) Since a measuring section for checking the weight of the reservoir can be assembled to the system, there is no accident of interruption of the process due to the lack of primary color during a metering step.

(f) A computerized color matching process can be easily accepted to the system, so that a high-efficiency metering operation can be attained.

(g) The system can be applied to miscellaneous liquid mixing processes other than a liquid paint mixing process.

We claim:

1. An apparatus for transporting a liquid reservoir and for metering a liquid therefrom into a collecting container comprising:

a substantially vertical supply shelf having means for storing a plurality of upright liquid reservoirs of the type having a slidable valve member in the tops thereof;

a liquid reservoir transferring mechanism, said transferring mechanism having a platform for supporting a liquid reservoir thereon, and said transferring mechanism having means for releasably attaching to a liquid reservoir on said supply shelf, drawing out a liquid reservoir from said supply shelf onto said platform, and for moving said platform having a liquid reservoir thereon horizontally and vertically to a metering position above a collecting container;

a balance having means for supporting and weighing a collecting container for receiving liquid metered from a value of a liquid reservoir at said metering position;

a tilting device at said metering position, said tilting device having means for receiving a liquid reservoir from said transferring mechanism, and for tilting a liquid reservoir from an upright orientation to a substantially horizontal orientation; and a valve mechanism at said metering position, said valve mechanism having means for actuating a slidable valve of a liquid reservoir for metering liquid from a valve into a collecting container on said balance when a liquid reservoir is in a substantially horizontal orientation in said metering position.

2. An apparatus as claim 1, wherein said means for actuating a slidable valve includes a valve drive member for moving a slidable valve member of a liquid reservoir, a cam attached to said valve drive member for reciprocating said valve drive member for opening and closing a slidable valve member, and a motor attached to said cam for driving thereof.

3. An apparatus as in claim 1, wherein said tilting device includes a measuring means for measuring a weight of a liquid reservoir received by said receiving means at said metering position, and said tilting device includes an attracting means for releasably holding a liquid reservoir during the tilting of a reservoir from an upright orientation to a substantially horizontal orientation.

4. An apparatus as in claim 3, wherein each one of said means for releasably attaching to a liquid reservoir and said attracting means for releasably holding a liquid reservoir is a suction cup connectable to a vacuum source.

* * * * *